US006964345B2

(12) United States Patent
Wetherell, Jr. et al.

(10) Patent No.: US 6,964,345 B2
(45) Date of Patent: Nov. 15, 2005

(54) BOTTLE WITH FACETED SURFACES AND RECESSED PANEL

(75) Inventors: Richard B. Wetherell, Jr., Gales Ferry, CT (US); Roger L. Paquin, Kerrville, TX (US); Jack E. Haney, Norcross, GA (US)

(73) Assignee: Silgan Plastics Corporation, Chesterfield, MO (US)

( * ) Notice: Subject to any disclaimer, the term of this patent is extended or adjusted under 35 U.S.C. 154(b) by 155 days.

(21) Appl. No.: 10/414,964

(22) Filed: Apr. 16, 2003

(65) Prior Publication Data

US 2004/0206718 A1 Oct. 21, 2004

(51) Int. Cl.[7] ..... B65D 21/00

(52) U.S. Cl. ..... 215/10; 215/379; 220/23.2; D9/652

(58) Field of Search ..... 215/10, 379, 383; 220/23.2, 23.4, 669; D0/522, 652, 744; D9/522, D9/652, 744

(56) References Cited

U.S. PATENT DOCUMENTS

| | | | | | |
|---|---|---|---|---|---|
| D79,336 | S | * | 9/1929 | Krank | D9/652 |
| D114,008 | S | * | 3/1939 | Blunt | D9/652 |
| D133,055 | S | * | 7/1942 | Aiken | D9/652 |
| D133,064 | S | * | 7/1942 | Meier, Jr. | D9/652 |
| 3,323,668 | A | * | 6/1967 | Hills | 215/10 |
| 3,583,590 | A | * | 6/1971 | Ferraro | 215/10 |
| 3,933,268 | A | * | 1/1976 | Buske | 220/23.4 |
| 4,194,619 | A | * | 3/1980 | Schley | 206/217 |
| 4,573,595 | A | * | 3/1986 | Mednis | 215/10 |
| 4,708,253 | A | * | 11/1987 | Mednis | 215/10 |
| D319,970 | S | | 9/1991 | Beeman | |
| D337,946 | S | * | 8/1993 | Bridger et al. | D9/523 |
| D446,124 | S | * | 8/2001 | Lehnert | D9/522 |
| D450,245 | S | * | 11/2001 | Schultz | D9/522 |
| D463,980 | S | * | 10/2002 | Baron | D9/522 |
| D475,286 | S | * | 6/2003 | Bomer | D9/417 |

FOREIGN PATENT DOCUMENTS

| | | | | |
|---|---|---|---|---|
| EP | 0098916 A2 | * | 1/1984 | |
| FR | 2552734 A3 | * | 4/1985 | B65D 21/02 |

* cited by examiner

*Primary Examiner*—Sue A. Weaver
(74) *Attorney, Agent, or Firm*—Pepe & Hazard LLP

(57) ABSTRACT

A blow molded synthetic resin container having a body of generally V-shaped cross section defined by a pair of V-shaped side walls, end walls extending therebetween, and a bottom wall. A cylindrical neck is open at its upper end, and an upwardly inclined shoulder extends between the upper ends of the side and end walls and the lower end of the neck. One of the side walls has a pair of wall portions which converge inwardly of the body towards the center axis of the body and the other of the side walls has wall portions which converge outwardly from the axis of the body. The other panel has a recess therein for a label.

8 Claims, 6 Drawing Sheets

FIG. 3
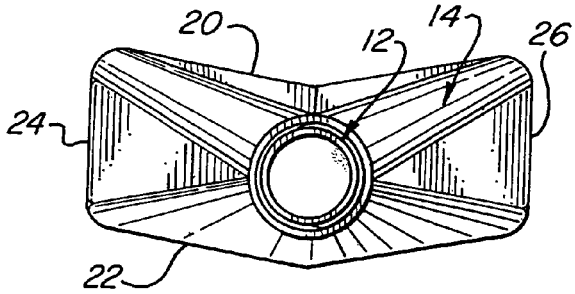
FIG. 1
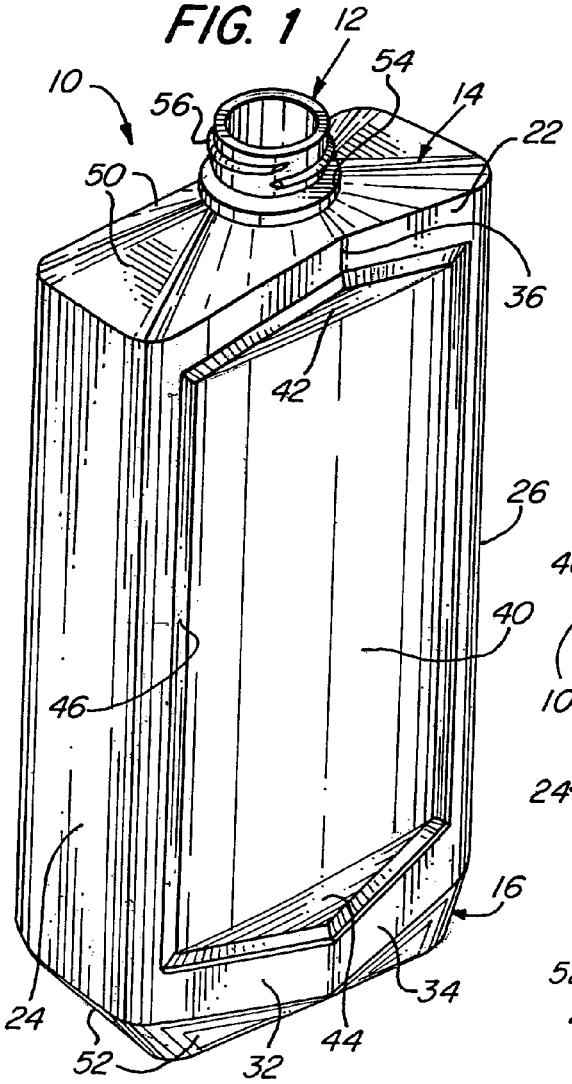
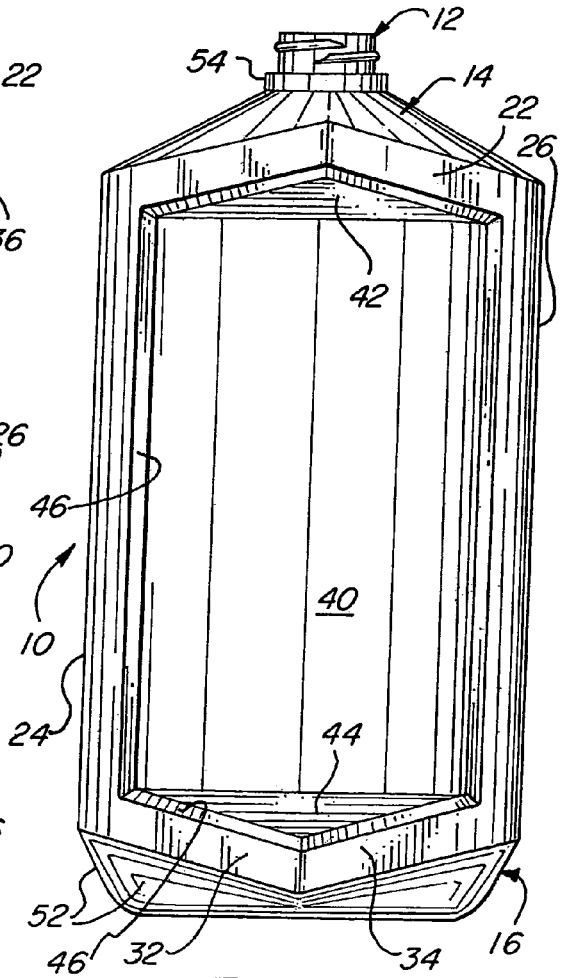
FIG. 2

BOTTLE WITH FACETED SURFACES AND RECESSED PANEL

BACKGROUND

The present invention relates to synthetic resin containers and, more particularly, to blow molded synthetic resin bottles having a faceted surfaces.

As is well known, blow molded synthetic resin containers are now widely employed for many applications and are produced in a variety of sizes and configurations. Plastic or paper labels are commonly adhered to the side wall of the containers to identify the product contents inside the container.

During transport, a quantity of product containers are usually nested together and shipped in larger, rectangular shaped shipping boxes. The packaging of cylindrical containers in rectangular shipping boxes often leaves large gaps between the product containers. These gaps, in turn, necessitate the usage of grid inserts to keep the product containers from shifting and damaging themselves, or their labels during transport.

The gaps between containers may be reduced, and almost eliminated, by using containers with rectangular cross sections, since they may be closely nested together in rectangular shipping boxes whose cross section is a multiple of the cross section of containers. However, closely packed, rectangular containers may still shift with respect to each other during transport, and their labels may be damaged as a result of shifting during transport or during packing and unpacking the containers from the shipping boxes.

Accordingly, it is an object of the present invention to provide a novel, blow molded synthetic resin container which may be closely nested with like containers to reduce or eliminate space therebetween and minimize shifting with respect to each other during transport.

It is also an object to provide such a container in which the labels are protected from abrasion caused by contact with like containers during transport, packing and unpacking the containers in larger, shipping boxes.

Another object is to provide such a container in which multiple panels have substantially planar surfaces which function as facets to reflect light.

SUMMARY OF THE INVENTION

It has now been found that the foregoing and related objects may be readily attained in a blow molded synthetic resin container having a body of generally V-shaped cross section defined by a pair of V-shaped side walls, end walls extending therebetween, and a bottom wall. Above the body is a cylindrical neck open at its upper end, and an upwardly inclined shoulder extends between the upper ends of the side and end walls and the lower end of the neck. One of the side walls has a pair of wall portions which converge inwardly of the body towards the axis and the other of the side walls has wall portions which converge outwardly from the axis of the body.

Desirably, the other side wall has a recess providing a center panel and triangular top and bottom planar wall portion framing the upper and lower ends of the center panel, and the center panel has a convexly curved surface. The other side wall also has beveled portions about the center panel and the triangular top and bottom panels. The shoulder is provided by a multiplicity of planar portions extending from the side and end walls. The neck may have an elongated neck which is at least half the height of the body, and as long as the body.

BRIEF DESCRIPTION OF THE DRAWINGS

FIG. 1 is a perspective view of a blow molded synthetic resin bottle embodying the present invention and having a relatively short neck in proportion to the height of its body;

FIG. 2 is a front elevational view of the bottle of FIG. 1;

FIG. 3 is a top view of the bottle of FIG. 1;

DETAILED DESCRIPTION OF THE PREFERRED EMBODIMENT

Figure 4:
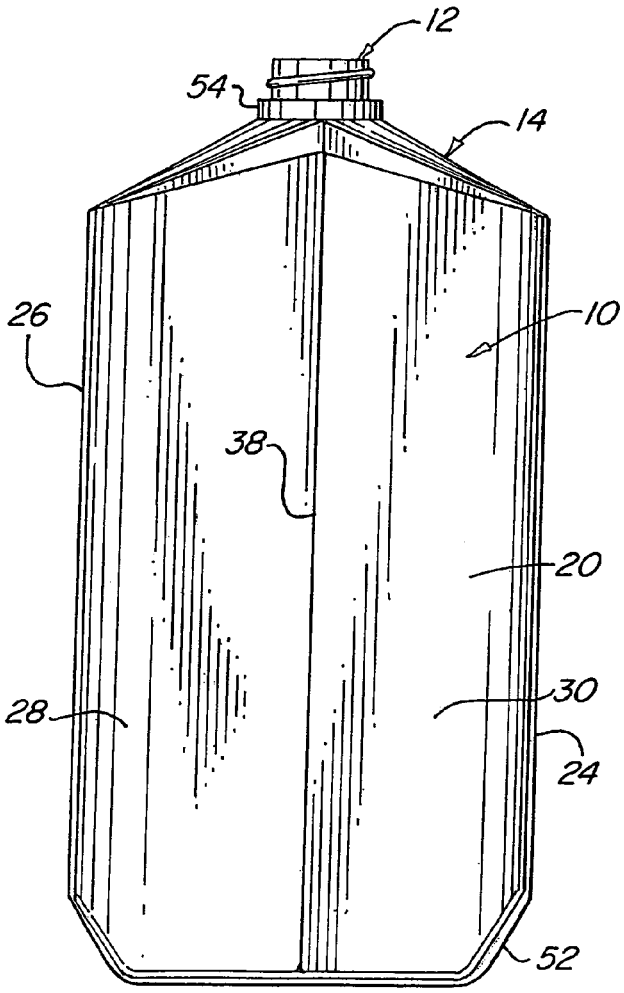
FIG. 4 is a rear elevational view of the bottle of FIG. 1.
Figure 5:
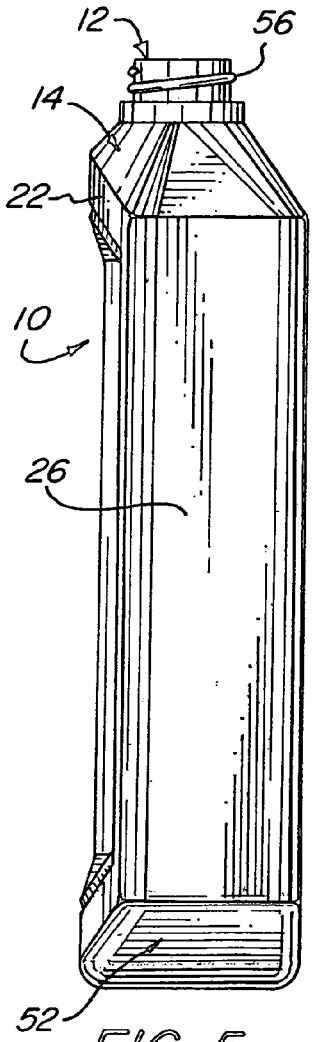
FIG. 5 is a side elevational view of the bottle of FIG. 1.

Turning first to FIGS. 1-6 of the attached drawings, therein illustrated is a bottle embodying the present invention which includes a body generally designated by the numeral 10, a neck generally designated by the numeral 12, and a shoulder generally designated by the numeral 14. The body 10 has a generally V-Shaped cross section, and a base portion generally designated by the numeral 16 which tapers inwardly to the bottom wall 18.

The generally V-shaped cross section of the body 10 is provided by a pair of generally parallel V-shaped side walls 20, 22 and end walls 24, 26. The side wall 20 has two wall portions 28, 30 which converge towards the center axis of the bottle, and the side wall 22 has two wall portions 32, 34 which diverge away from the axis. The wall portions 28, 30 and 32, 34 meet at a relatively large angle included along the convergence lines 36, 38 which are located intermediate the width of the bottle. The V-shaped cross section of the body 10 allows the bottle to be closely nested with like bottles in rectangular shaped shipping containers or boxes and minimizes the tendency of bottles to laterally shift with respect to each other during shipment.

The side wall 22 of the body 10 includes a recessed panel 40 for locating and protecting a label (not shown). The panel 40 is convexly curved with a large radius of curvature so that its apex is inwardly of the wall 22 about the recessed panel 40.

As illustrated in FIG. 2, the recessed panel 40 has triangular top and bottom portions 42, 44, which define the upper and bottom margins thereof and which are inclined from the surface of the peripheral portion of the side wall 22. The recessed panel 40, the top and bottom triangular portions 42, 44, is framed about its periphery by a relatively narrow beveled portion 46.

Figure 6:
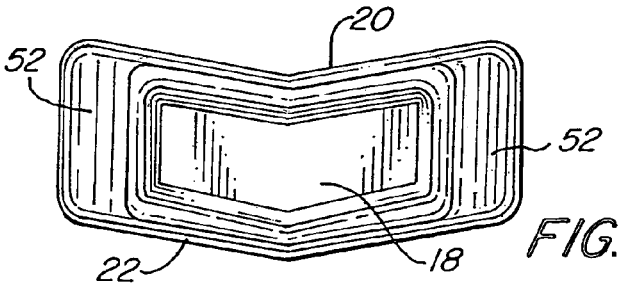
FIG. 6 is a bottom view of the bottle of FIG. 1.
Figure 9:
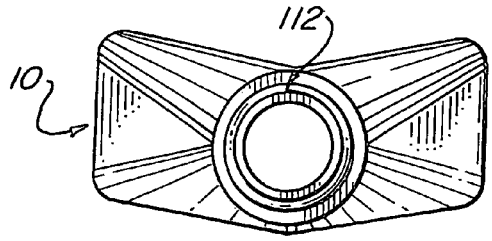
FIG. 9 is a top view of the bottle of FIG. 7.
Figure 7:
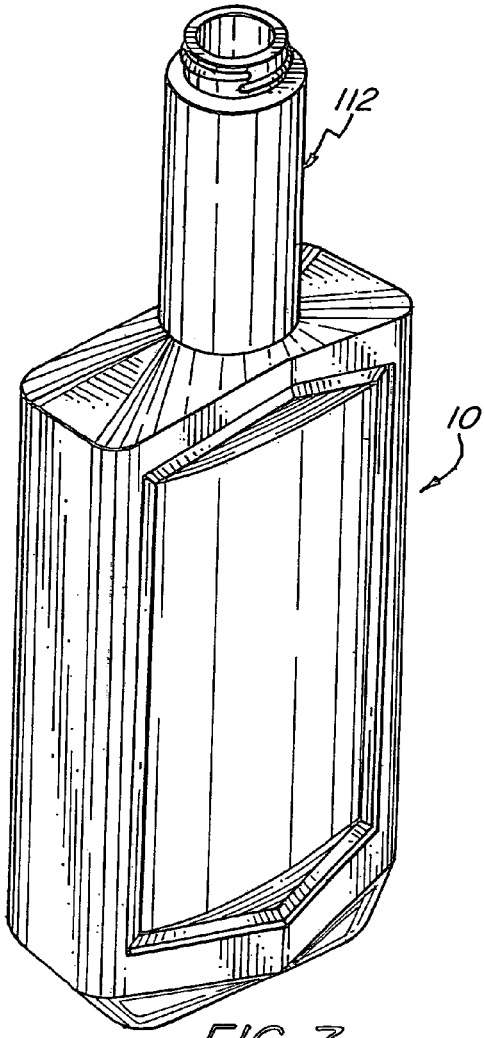
FIG. 7 is a perspective view of another embodiment of a blow molded synthetic resin bottle embodying the present invention and having an elongated neck approximately one-half the height of its body.
Figure 8:
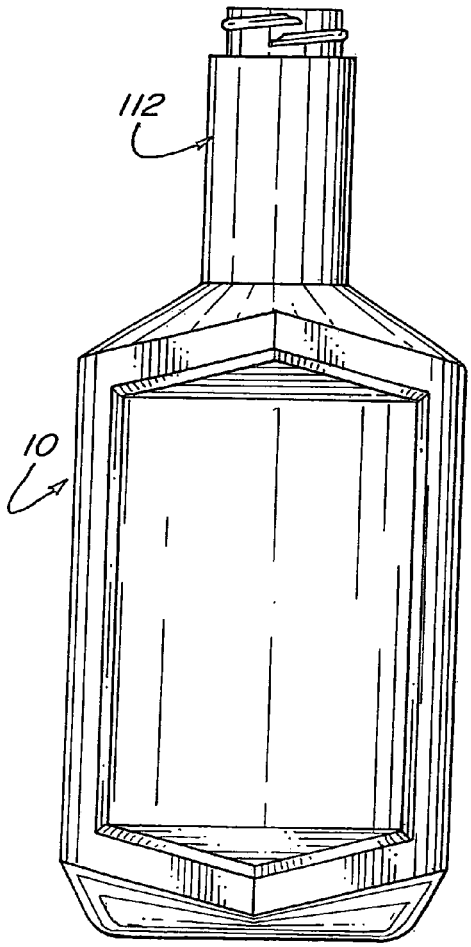
FIG. 8 is a front elevational view of the bottle of FIG. 7.
Figure 10:
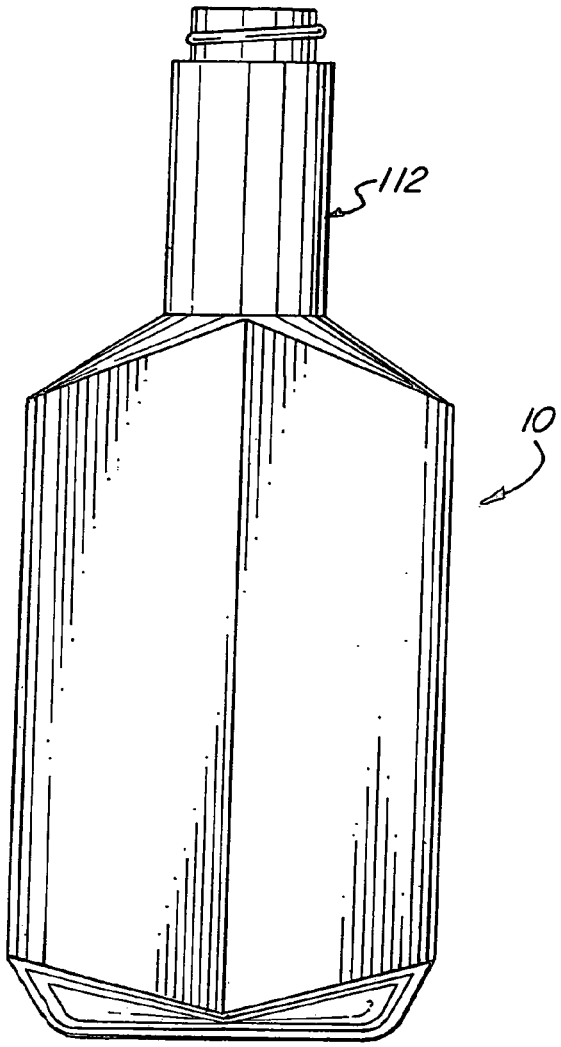
FIG. 10 is a rear elevational view of the bottle of FIG. 7.
Figure 11:
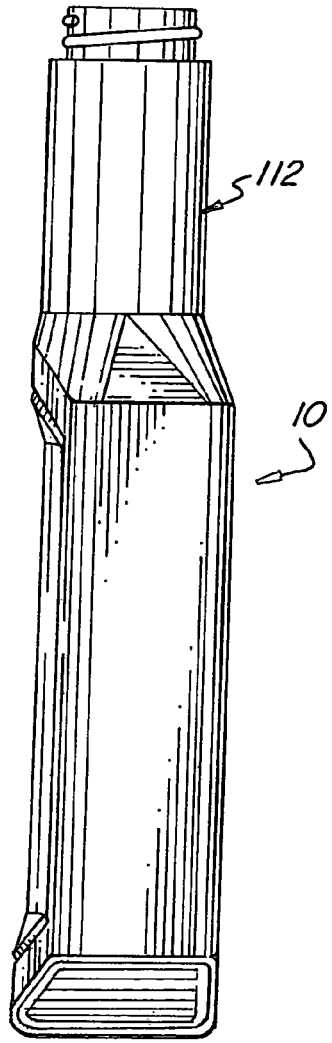
FIG. 11 is a side elevational view of the bottle of FIG. 7.
Figure 12:
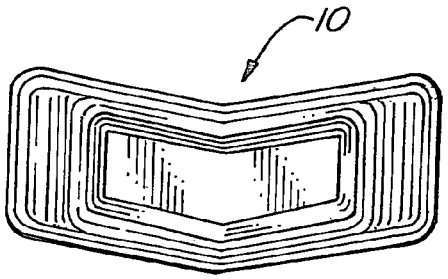
FIG. 12 is a bottom view of the bottle of FIG. 7.
Figure 15:
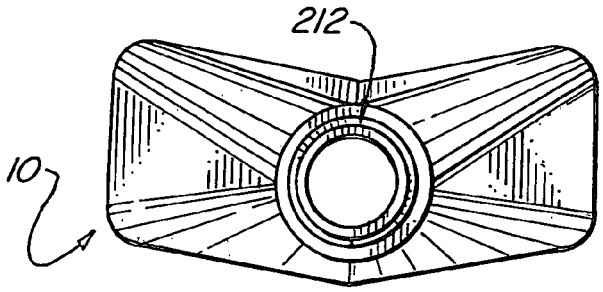
FIG. 15 is a top view of the bottle of FIG. 13.
Figure 13:
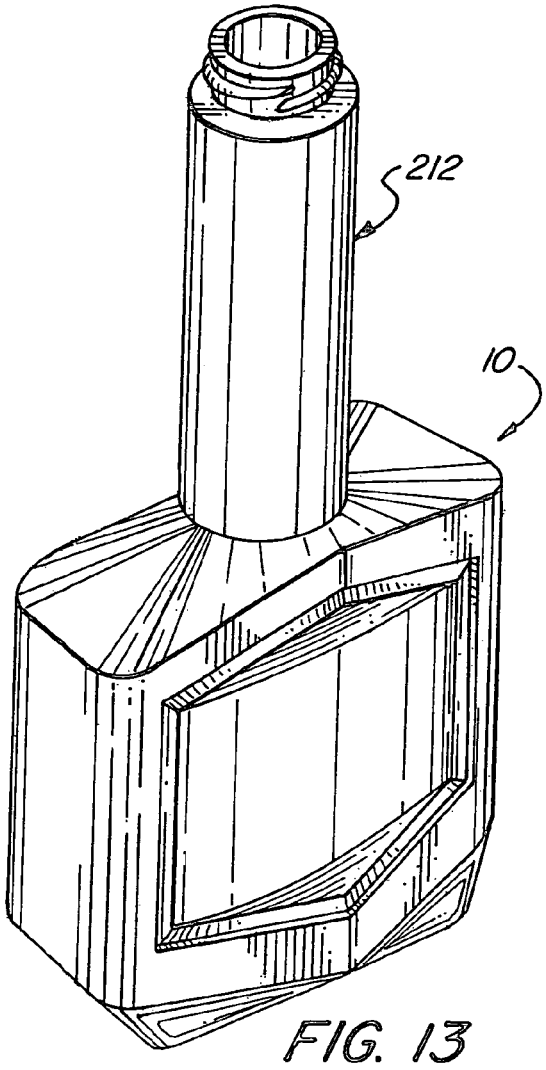
FIG. 13 is a perspective view of yet another embodiment of a blow molded synthetic resin bottle embodying the present invention and having a neck approximately equal in height to the height of its body.
Figure 14:
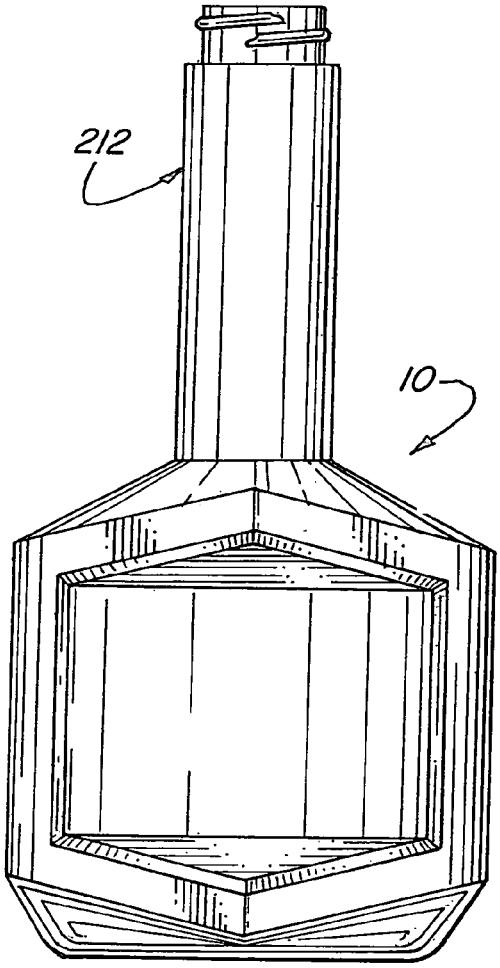
FIG. 14 is a front elevational view of the bottle of FIG. 13.
Figure 18:
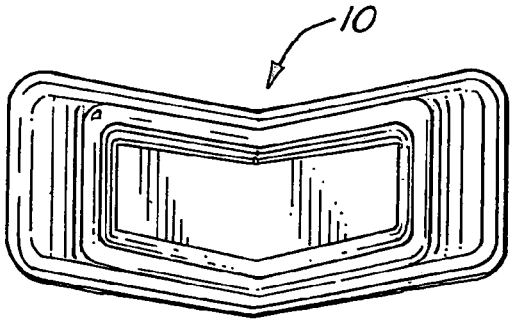
FIG. 18 is a bottom view of the bottle of FIG. 13.
Figure 16:
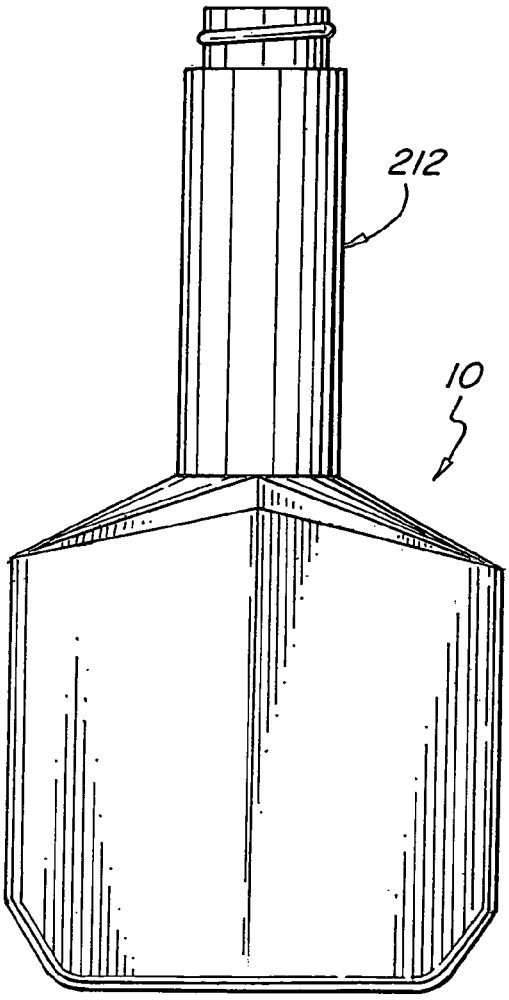
FIG. 16 is a rear elevational view of the bottle of FIG. 13.
Figure 17:
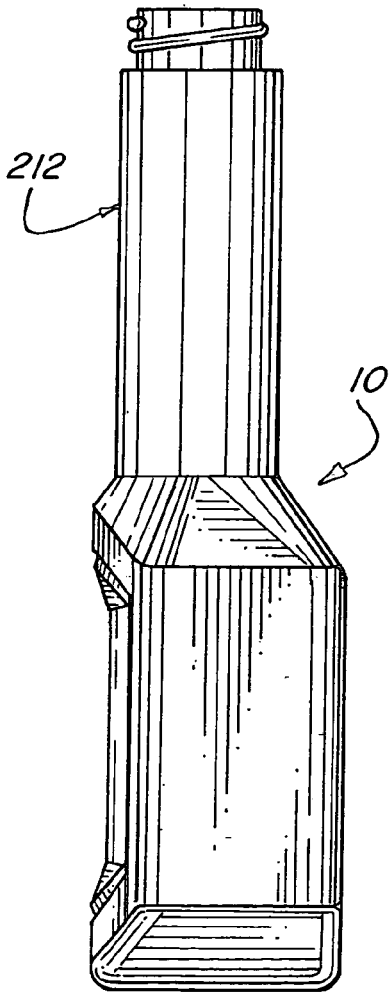
FIG. 17 is a side elevational view of the bottle of FIG. 13.

The shoulder 14 is comprised of a multiplicity of planar portions 50 disposed at angles relative to the adjacent planar portions 50 to provide facets. The base portion 16 is comprised of base planar wall portions 52 which taper inwardly to the bottom wall 18 as best seen in FIGS. 2 and 6. The neck 12 has a collar 54 about its lower end and a thread 56.

In use, a quantity of bottles may be nested together (not shown) with the converging side wall 20 of one bottle seated against the diverging side wall 22 of an adjacent bottle. The end walls 24, 26 of one bottle abut the walls 24, 26 of adjacent bottles, and thereby counter any forces occurring transversely across the bottle which might otherwise cause lateral shifting of the bottles with respect to each other in the transverse plane.

The embodiment of FIGS. 7–12 has the same body configuration as the embodiment of FIGS. 1–6, but the neck 112 is elongated with a vertical height approximating half the height of the body. The embodiment of FIGS. 13–18 has a neck 212 which approximates the vertical height of the body. The bottles can be readily fabricated in accordance with conventional stretch blow molding processes utilized with resins such as polyethylene terephthalate as well as with other thermoplastic resins.

Thus, it can be seen from the foregoing detailed description and accompanying drawings that the novel bottle of the present invention is one which may effectively resist lateral shifting of the bottle when nested together with like bottles during transport. The recessed panel effectively protects the label from abrasion during handling such as packing or unpacking with like bottles during shipment. In addition to providing a bottle which nests readily in cartons and protects the label, the multiple sloped planar portions of the peripheral surface function as facets to reflect light and produce an eye catching appearance.

Having thus described the invention, what is claimed is:

1. A blow molded synthetic resin container having:

(a) a body of generally V-shaped cross section defined by a pair of V-shaped side walls, end walls extending therebetween, and a bottom wall;

(b) a cylindrical neck open at its upper end; and (c) an upwardly inclined shoulder extending between the upper ends of said side and end walls and the lower end of said neck, said body having a vertical axis extending through said neck, one of said side walls having a pair of wall portions which converge inwardly of said body towards said axis and the other of said side walls having wall portions which converge outwardly from said axis of said body, said other side wall having a recess providing a center panel and triangular top and bottom planar wall portions framing the upper and lower ends of said center panel.

2. The container in accordance with claim 1 wherein said other side wall has beveled portions framing said center panel and said triangular top and bottom planar wall portions.

3. The container in accordance with claim 1 wherein said neck is elongated.

4. The container in accordance with claim 1 wherein said shoulder is provided by a multiplicity of adjacent planar portions extending from said side and end walls.

5. The container in accordance with claim 1 wherein said neck is at least one half the height of said body.

6. A blow molded synthetic resin container having:

(a) a body of generally V-shaped cross section defined by a pair of V-shaped side walls, end walls extending therebetween, and a bottom wall;

(b) a cylindrical neck open at its upper end; and (c) an upwardly inclined shoulder extending between the upper ends of said side and end walls and the lower end of said neck, said body having a vertical axis extending through said neck, one of said side walls having a pair of wall portions which converge inwardly of said body towards said axis and the other of said side walls having wall portions which converge outwardly from said axis of said body, said other side wall having a recess providing a center panel and triangular top and bottom planar wall portions framing the upper and lower ends of said center panel, said side walls having base planar wall portions along the bottom thereof which taper inwardly to said bottom wall.

7. The container in accordance with claim 6 wherein said other side wall has beveled portions framing said center panel and said triangular top and bottom planar wall portions.

8. The container in accordance with claim 6 wherein said neck is at least one half the height of said body.

* * * * *